United States Patent [19]

Chaumette

[11] Patent Number: 4,579,076

[45] Date of Patent: Apr. 1, 1986

[54] HYDROFOIL DEVICE STABILIZED BY A TAIL UNIT, AND MARINE CRAFT EQUIPPED WITH THIS DEVICE

[76] Inventor: Daniel E. Chaumette, Résidence "La Villedieu", Bâtiment A, 1 Avenue Paul Cézanne, 78310 Elancourt, France

[21] Appl. No.: 610,990

[22] PCT Filed: Sep. 14, 1983

[86] PCT No.: PCT/FR83/00179

§ 371 Date: May 8, 1984

§ 102(e) Date: May 8, 1984

[87] PCT Pub. No.: WO84/01137

PCT Pub. Date: Mar. 29, 1984

[30] Foreign Application Priority Data

Sep. 15, 1982 [FR] France ..... 82 15630

[51] Int. Cl.[4] ..... B63B 1/28

[52] U.S. Cl. ..... 114/275

[58] Field of Search ..... 114/271–282; 244/82

[56] References Cited

U.S. PATENT DOCUMENTS

| | | | |
|---|---|---|---|
| 1,186,816 | 6/1916 | Meacham | 114/281 |
| 2,584,347 | 2/1952 | Hazard | 114/281 |
| 3,141,437 | 7/1964 | Bush et al. | 114/276 |
| 3,762,353 | 10/1973 | Shutt | 114/281 |

*Primary Examiner*—Galen L. Barefoot
*Assistant Examiner*—Jesûs D. Sotelo
*Attorney, Agent, or Firm*—Wigman & Cohen

[57] ABSTRACT

Hydrofoil device supported by a strut (1) and including a moving assembly articulated along an axis (2) and including a main carrier plane (3) and a tail unit (4) connected by a fuselage (5); the tail unit being offset in the vertical plane with respect to the main carrier plane. The tail unit provides a natural stability to the assembly and particularly allows to stabilize the main carrier plane at an immersion depth determined by the offsetting (6). The hydrofoil is applicable to all fast nautical crafts.

6 Claims, 6 Drawing Figures

HYDROFOIL DEVICE STABILIZED BY A TAIL UNIT, AND MARINE CRAFT EQUIPPED WITH THIS DEVICE

BACKGROUND OF THE INVENTION

The present invention relates to a hydrofoil device (also called hydropter) with a tail unit, intended to be used on fast marine craft. It also embraces the marine craft equipped with this device. The use of hydrofoils is a technique increasingly in use in fast boats, with motor or with sail, in order to improve their performances above a certain speed, by replacing the lift of hydrostatic origin by the hydrodynamic lift of a system of submerged fins.

Two main types are currently used:

hydrofoils in which the principal bearing surfaces, generally inclined relative to the surface of the water, are only partially submerged and cross the surface, hydrofoils in which the bearing surfaces are completely submerged during normal functioning.

The first type has the advantage that it may lead to configurations where the marine craft is naturally stable relative to the surface of the water. On the other hand, it has the disadvantage of having a higher drag than the second type.

The second type on the other hand has no natural stability and must be piloted continuously. Some boats employing this type of hydrofoil are currently stabilised by an automatic pilot system acting upon rudders through the intermediary of hydraulic jacks. This leads to an expensive, heavy and complicated system.

SUMMARY AND OBJECTS OF THE PRESENT INVENTION

The present invention deals with a hydrofoil system related to the second type, but arranged to exhibit natural stability and automatic regulation of the depth of immersion without the action of a control system.

According to a feature of the invention, the principal bearing surface, which is totally immersed, during functioning, at a certain depth below the surface, is combined with a tail unit or auxiliary bearing surface which is elevated relative to the principal bearing surface, so as to become immersed when the system rises and whilst the principal surface is still totally immersed. The reduction in the lift exerted upon the tail unit then causes a reduction in the incidence of the principal surface and a correlative reduction in its lift, so that the system tends to immerse further.

Conversely, if the system tends to sink, the lift upon the tail unit increases, which causes an increase in the incidence of the principal surface and, correlatively, a rise of the system, so that stabilization finally occurs.

The tail unit is preferably in front of the principal bearing surface in the direction of progress of the boat.

It is already known from Dutch Patent No. 34.042 to associate an auxiliary bearing surface of controlled inclination with a principal bearing surface, but in the known arrangement, contrary to the invention, the auxiliary surface is at a lower level than that of the principal bearing surface, so that the automatic stabilization effect achieved by the invention cannot be obtained.

The accompanying drawing given by way of example illustrates embodiments of the invention.

DETAILED DESCRIPTION OF A PREFERRED EMBODIMENT

Figure 1:
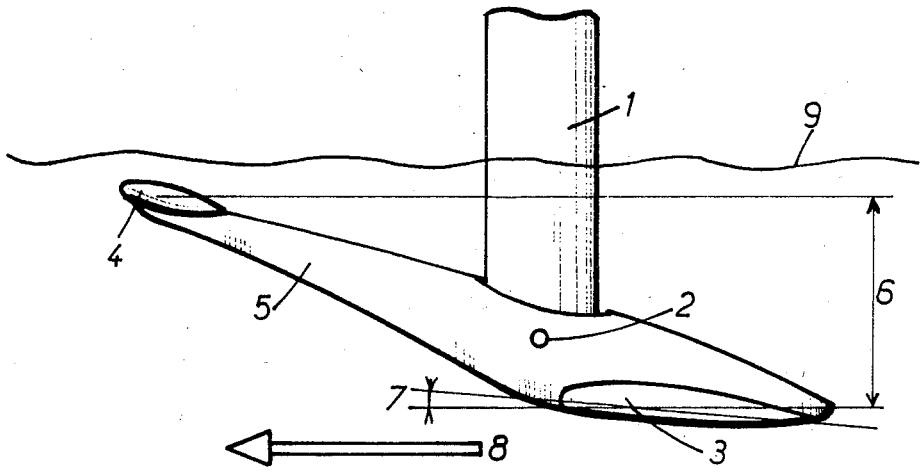
FIG. 1 is a view in profile, in side elevation, of a device according to the invention.
Figure 2:
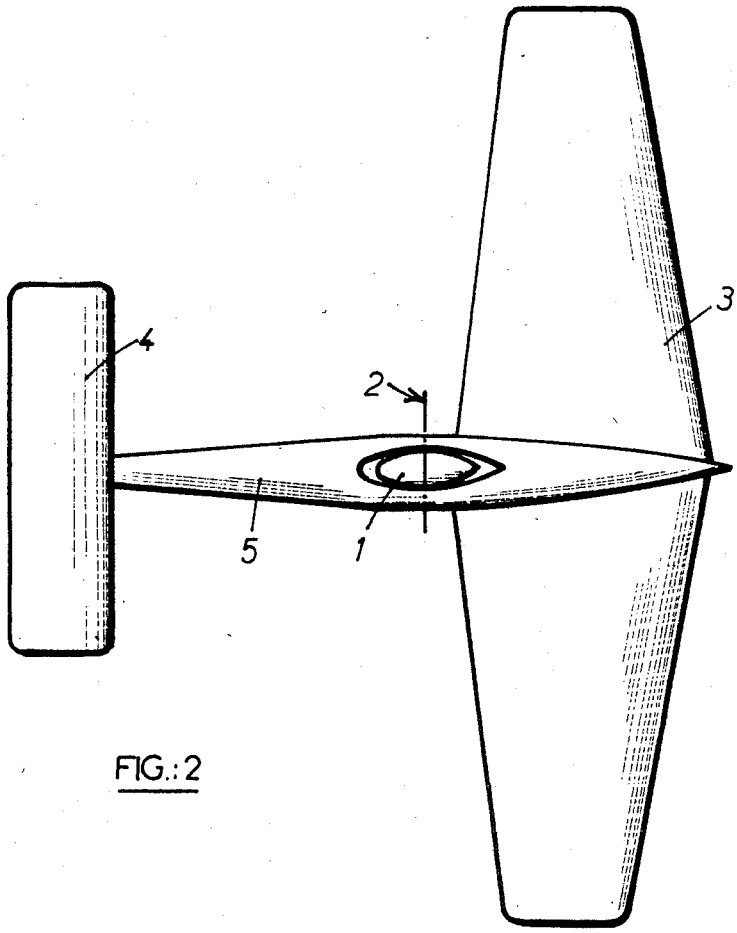
FIG. 2 is a plan view of the same.

The embodiment illustrated in FIG. 1 comprises a principal bearing surface 3 which will henceforth be called "principal plane", or main foil it being understood that said suface may have a form other than that of a plane, and may be for example a biplane, with a forward horizontal tail unit or auxiliary foil 4 and a fuselage 5 connecting the two bearing elements.

The tail unit is located at a certain height 6 above the principal plane 3. The assembly is articulated by the axis of articulation 2 on a profiled strut 1, which supports a marine device, for example a boat.

The functioning of the device is as follows:

When deeply immersed below the surface of the water 9 and progressing in the direction of the arrow 8, the assembly 3-4-5, by pivoting about the axis 2, assumes a position such that the principal plane 3 adopts a certain incidence 7 which is stable, subject to the condition that the axis of articulation 2 has been placed forward of the hydrodynamic centre of the assembly 3-4-5. This angle of incidence 7 is a function of the steering of its forward tail unit, which may either have been predetermined, or can be regulated during navigation (through the intermediary of a flexible-sheathed cable control, for example). When the boat accelerates and the lift becomes sufficient to raise it, the movable assembly approaches the surface. Due to the offset in height 6 relative to the principal bearing plane, the forward tail unit approaches the surface first. Its lift then decreases due to surface action, whereas the lift of the principal plane 3 remains unchanged, which causes a reduction in the incidence of equilibrium 7 and hence a reduction in the lift of the movable assembly. The hydrofoil assembly then becomes stabilized at such a depth of immersion that the tail unit is near the surface of the water, and the principal bearing plane at a depth which is a function of the offset 6, thus ensuring high efficiency.

Figure 3:
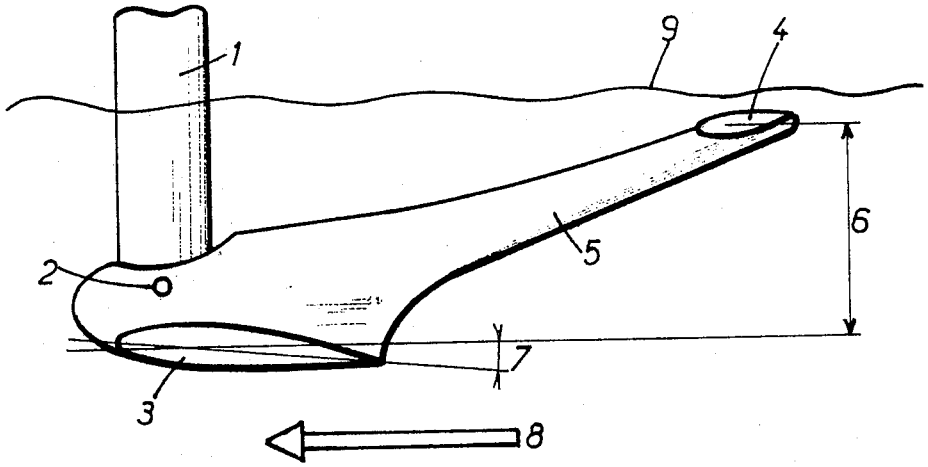
FIG. 3 shows an alternative embodiment.

In the variant of the invention illustrated in FIG. 3, the same elements are found again: strut 1, axis of articulation 2, principal bearing plane 3, tail unit 4, fuselage 5. The only difference is that the tail unit is placed astern of the principal plane relative to the direction of progress 8. The tail unit is again offset in height (offset 6) relative to the principal bearing plane.

The functioning is similar to that of the basic invention, however the stability condition is obtained subject to the condition that the axis of articulation 2 is forward of hydrodynamic centre of the movable assembly without its tail unit. The angular setting of the latter relative to the fuselage 5 is such that the lift pertaining to the tail unit is directed downwards, whereas it is directed upwards in the case of FIG. 1.

Other variants of the basic invention may be realised whilst retaining the same functioning principle by stabilizing action of tail units and regulation of the depth of immersion by surface action upon the tail units.

For example, the axis of articulation of the movable assembly may be carried by a plurality of struts, the movable assembly may have one or more principal bearing planes and one or more tail units carried by one or more fuselages.

Figure 4:
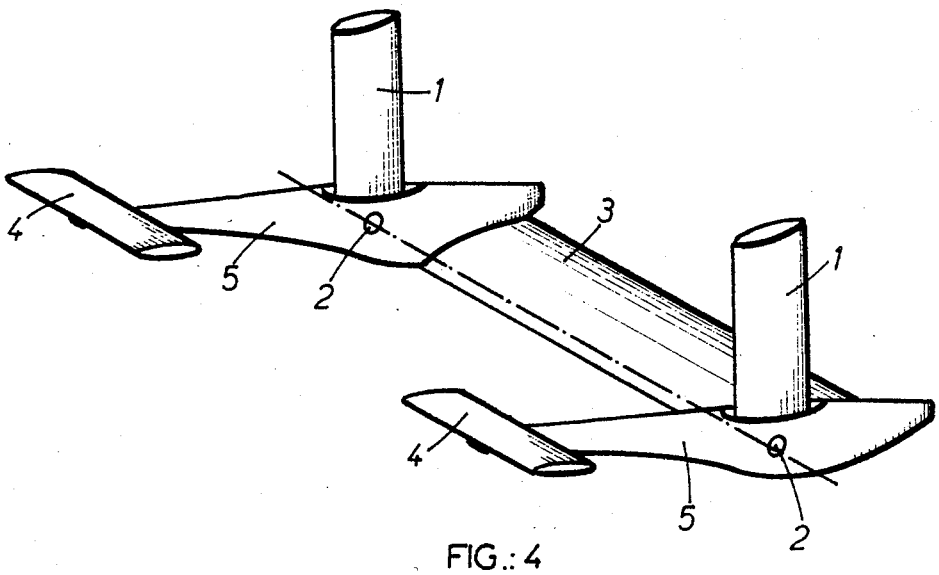
FIG. 4 is a perspective view of an assembly comprising two tail units associated with one and the same principal surface.

FIG. 4 illustrates an example in which the principal plane 3 is attached to two fuselages 5 each comprising a tail unit 4 and respectively articulated at 2 to struts 1 supporting the boat. The axes of articulation 2 are aligned.

It is also possible to deduce, from this FIG. 4, another embodiment in which the principal plane 3, integral with the fuselages 5 carrying the tail units 4, would be articulated to a single strut placed between the fuselages 5.

In order to obtain correct functioning of the invention, it may be necessary to limit, by mechanical stops, the movement of the movable assembly relative to the associated strut.

Similarly, it may be useful to damp the movements of the movable assembly by the use of movement dampers.

Figure 5:
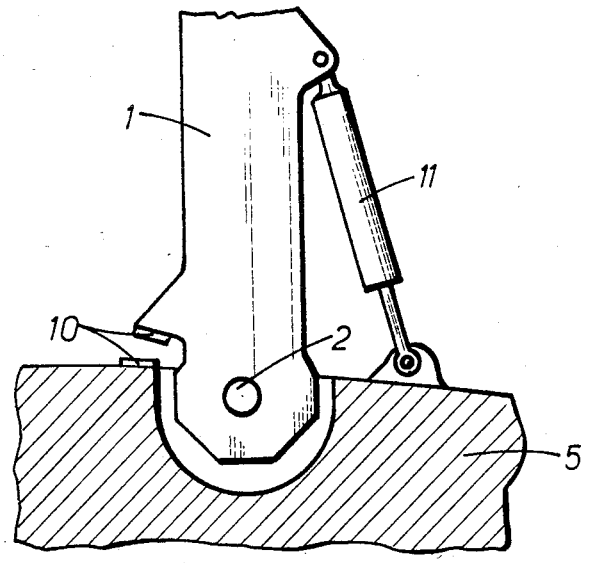
FIG. 5 shows an embodiment of the articulation of the assembly of principal bearing surface, fuselage and tail unit.

FIG. 5 shows an exemplary embodiment of such a joint between the strut 1 and the fuselage 5 of the movable assembly. The axis of articulation 2 is equipped with movement stops 10 and with a hydraulic damper 11.

In this embodiment as in the embodiments formerly described, the assembly consisting of the main foil 3, the auxiliary foil 4 and the fusiform body 5 is free to rotate about the axis 2, inside the travel delimited by the stop 10 and the damper 11, respectively, so as to take an equilibrium under the sole action of the hydrodynamic forces exerted on the assembly. The function of the damper is only to damp the oscillations.

The invention, in its various forms, is applicable to all fast marine craft, with sail or with motor (particularly fast motor boats, multiple-hull sailing boats, sailing rafts).

Figure 6:
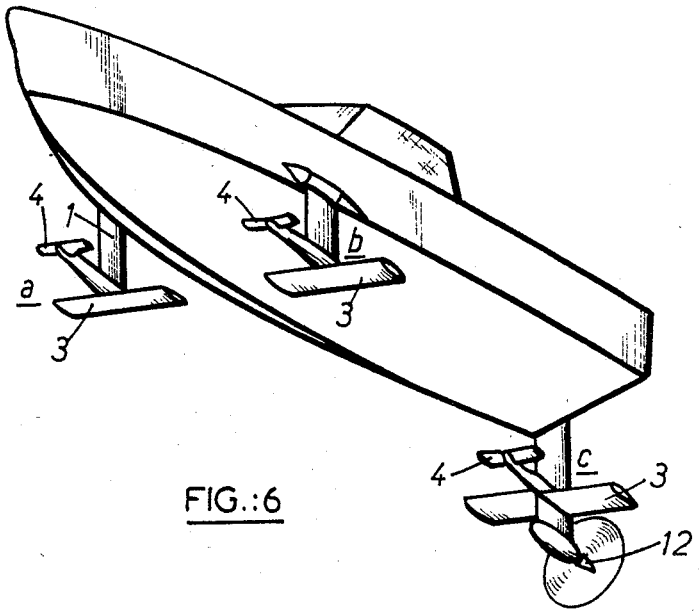
FIG. 6 is a perspective view of a boat comprising three devices according to FIG. 1.

They may serve either partially to lighten their weight, or to support them totally, which then necessitates a minimum of three independent assemblies. FIG. 6 shows an example of application to a fast motor boat employing three bearing assemblies a, b, c constructed according to FIG. 1.

These assemblies may be raisable or foldable for maneuvering at low speeds. They may also perform the function of drop-keel or rudder, and be integrated with the drive assembly, for example, a screw carried by the rear assembly c which also functions as a rudder, its strut 1 in that case being mobile in rotation about a vertical axis.

I claim:

1. In a watercraft, a hydrofoil device, comprising:

an assembly comprising a main foil, a self-stabilizing auxiliary foil and a fusiform body assembling said main foil and said auxiliary foil in such a manner that said auxiliary foil is able to work at a level higher than the said main foil;

pivot means for pivotally mounting said assembly to the structure of the craft in a self-stabilizing manner so that the assembly is free to rotate and assume an equilibrium position under the sole external action of the hydrodynamic forces exerted on the assembly, said pivot means being forward of the hydrodynamic center of said assembly;

means for limiting the angular travel of the assembly about said pivot means, to an angular travel wherein the auxiliary foil works at a level higher than the main foil, the assembly being free to rotate in said angular travel for taking its equilibrium position under the sole external action of the hydrodynamic forces exerted on said assembly.

2. A device as claimed in claim 1 wherein said limiting means comprises a damper designed to damp the harmonic oscillations of the assembly.

3. A device according to claim 1, wherein the auxiliary foil is arranged forward of the main foil.

4. The watercraft, comprising:

a plurality of hydrofoil devices, each of said devices including a main foil, an auxiliary foil, and a fuselage interconnecting the main foil and the auxiliary foil;

a like plurality of means for pivotally interconnecting the hydrofoil devices to the watercraft; and means for propelling the watercraft mounted on one of the hydrofoil devices;

wherein the plurality of hydrofoil devices comprises three hydrofoil devices arranged so as to form a triangle;

wherein each of the hydrofoil devices is connected to its interconnecting means in a pivotal manner so that the hydrofoil devices are free to rotate and assume an equilibrium position under the sole external action of the hydrodynamic forces exerted on the device; and wherein the auxiliary foils are set such that the lift pertaining to the auxiliary foils is directed downwards.

5. In a watercraft, a hydrofoil device, comprising:

an assembly comprising a main foil, a stabilizing auxiliary foil placed astern of the main foil, and a fusiform body assembling said main foil and said auxiliary foil in such a manner that said auxiliary foil is able to work at a level higher than the said main foil;

pivot means for pivotally mounting said assembly to the structure of the craft, said pivot means being forward of the hydrodynamic center of the main foil;

means for limiting the angular travel of the assembly about said pivot means, to an angular travel wherein the auxiliary foil works at a level higher than the main foil, the assembly being free to rotate in said angular travel for taking its equilibrium position under the sole external action of the hydrodynamic forces exerted on said assembly.

6. The device according to claim 5, wherein the auxiliary foil is set such that the lift pertaining to the auxiliary foil is directed downwards.

* * * * *